United States Patent [19]

Griffiths et al.

[11] Patent Number: 4,505,811

[45] Date of Patent: Mar. 19, 1985

[54] MINERAL PROCESSING APPARATUS

[75] Inventors: Anthony J. Griffiths, Berkeley Vale; David W. Allen, North Perth, both of Australia

[73] Assignee: Vickers Australia Limited, Melbourne, Australia

[21] Appl. No.: 543,116

[22] Filed: Oct. 14, 1983

[30] Foreign Application Priority Data

Oct. 15, 1982 [AU] Australia ..... PF6368

[51] Int. Cl.[3] ..... B03B 7/00

[52] U.S. Cl. ..... 209/17; 209/31; 209/144; 209/210; 209/211

[58] Field of Search ..... 209/17, 31, 144, 210, 209/211

[56] References Cited

U.S. PATENT DOCUMENTS

| | | | |
|---|---|---|---|
| 2,431,560 | 11/1947 | Humphreys | 209/211 |
| 2,615,572 | 10/1952 | Hodge | 209/211 |
| 2,661,839 | 12/1953 | Bush | 209/17 |
| 2,952,360 | 9/1960 | Oberg | 209/211 |
| 3,008,574 | 11/1961 | Clawson et al. | 209/211 X |
| 3,008,575 | 11/1961 | Clawson et al. | 209/211 X |
| 3,237,763 | 3/1966 | Wikdahl | 209/211 X |
| 3,456,785 | 7/1969 | Roller | 209/17 |
| 3,615,009 | 10/1971 | Norton | 209/144 X |
| 3,891,546 | 6/1975 | Humphreys | 209/211 |
| 4,152,253 | 5/1979 | Summers | 209/17 |
| 4,378,290 | 3/1983 | Kennedy, Jr. | 209/17 X |
| 4,384,650 | 5/1983 | Wright | 209/211 X |
| 4,386,519 | 6/1983 | Sinkey | 209/211 X |

*Primary Examiner*—Robert Spitzer

*Attorney, Agent, or Firm*—Berman, Aisenberg & Platt

[57] ABSTRACT

Mobile mineral processing apparatus comprising at least one module having a base, frame structure and a roof. The base is mounted on skids or the like whereby the module can be moved from place to place at will. Also, each module is demountable for convenient transport from one site to another and for convenient reassembly at the new site. In a basic form of the apparatus there is a preliminary separation module having an inclined screen for separating feed material into waste and treatment components, and a concentrator module having several banks of spiral concentrators which receive the treatment component and process that component to achieve a satisfactory level of recovery of the mineral of interest. Water and power distribution systems together with ancilliary equipment such as pumps and motors are provided as an integral part of the apparatus. The apparatus is therefore self contained and fully operational subject only to connection of external sources of water and power.

22 Claims, 9 Drawing Figures

MINERAL PROCESSING APPARATUS

This invention relates to mineral processing apparatus which is particularly suited for processing sand and alluvial deposits, but the invention is also applicable to mineral concentration from hard rock.

Mineral processing apparatus is generally built on a substantially fixed basis in that it is not mobile or has very limited mobility. That seriously limits the scope of use of such apparatus. Also, such apparatus often has a relatively low level of recovery so that it is not usable, at least commercially, with low yield feed materials. In that regard, a low yield material is to be understood as one in which the mineral of interest is present in fine particles—for example, in the case of cassiterite, in the size range 2 mm to 40 microns.

It is an object of the present invention to provide mineral processing apparatus which is mobile, at least to a limited extent, and which is usable with relatively low yield feed materials. It is another object of the invention to provide such apparatus which can be supplied in kit or demounted form and assembled on site. Still another object of the invention is to provide such apparatus which is capable of standing alone from other processing equipment.

According to the present invention, there is provided a mobile mineral processing apparatus comprising; a plurality of groups of gravity concentrators, at least one of which includes spiral concentrators; a plurality of treatment means including primary separation means, scavenging means, and cleaning means; each of at least two of said treatment means including a said group of gravity concentrators; at least one module carrying said treatment means, water reticulation means and control means for regulating the flow of material through said apparatus; said module having a base, a frame structure and a roof, and said base is engagable with the ground for movement thereover.

In most arrangements there will be at least two modules, one of which forms a concentrate module and the other forms a preliminary separation module. Some arrangements may involve additional modules such as a primary screen module and a fine dressing module. The concentrate module will generally include several banks of spiral concentrators arranged to separate the mineral of interest even when present in the form of relatively fine particles. Other types of gravity concentrators may be included in that module.

The mobility of each module is usually limited in that it is moved by sliding over the ground. Even such limited mobility however, enables the apparatus to be moved from place to place such that the usefulness of the apparatus at a particular location is optimized. Assuming there are several modules, they may be secured together at each selected place of operation of the apparatus. Preferably, external sources of power and water are each connected to a respective single connection point provided on the apparatus. Distribution and control of the power and water throughout the apparatus is attended to be means forming an integral part of the apparatus.

It is preferred that each module is constructed in a manner such as to permit convenient dismantling and subsequent reassembly. That enables the apparatus to be assembled at the point of construction for testing purposes and then dismantled for convenient transport to a remote location at which the apparatus is to be used.

The apparatus is therefore able to be moved from one location to another and is usable in locations at which cost and other factors may rule against erection of a permanent processing plant.

In subsequent passages of this specification there will be reference to material of high or low classification. The classification of material processed by the apparatus is its degree of acceptability as a product of the process performed by the apparatus. For example, material of very low classification may be rejected to waste as having little or no recoverable content of the mineral of interest. Material of very high classification may be material substantially composed of the mineral of interest and therefore an acceptable end product, whereas material between the low and high classifications may be suited for further processing.

The essential features of the invention, and further optional features, are described in detail in the following passages of the specification which refer to the accompanying drawings. The drawings however, are merely illustrative of how the invention might be put into effect, so that the specific form and arrangement of the features (whether they be essential or optional features) shown is not to be understood as limiting on the invention.

Figure 1:
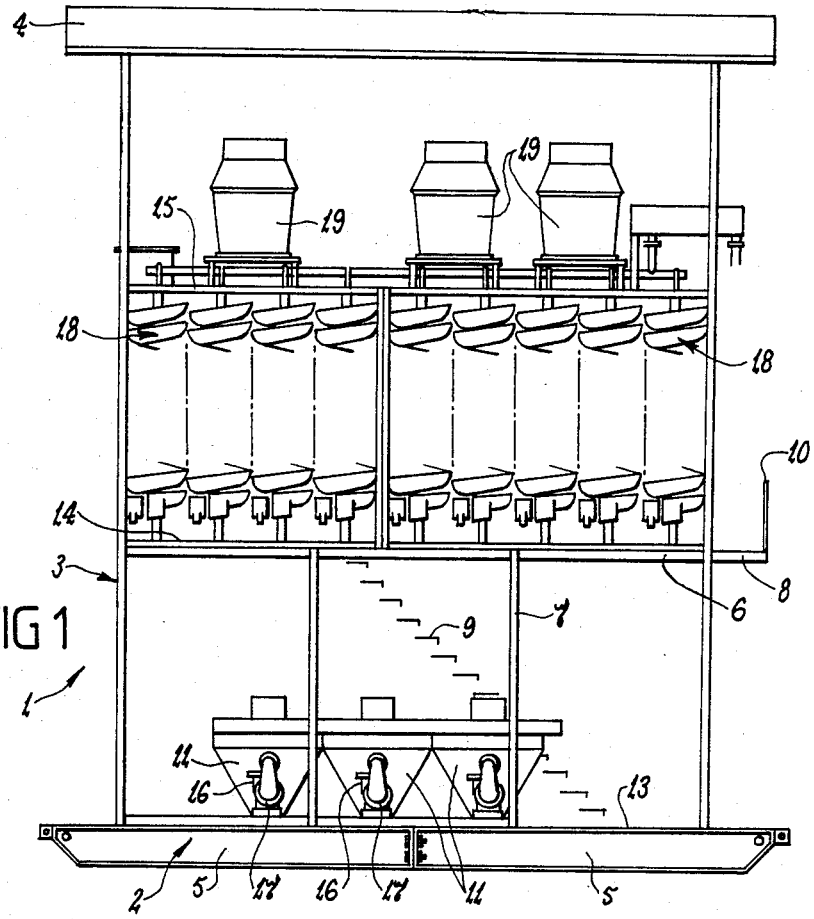
FIG. 1 is a semi diagrammatic side elevation view of a basic form of the apparatus according to one embodiment of the invention.

According to a basic form of the apparatus as shown in FIG. 1, it includes a single module 1 having a base 2, a frame structure 3 mounted on the base 2 and a roof 4 at the top of the frame structure 3. The base 2 is constructed to facilitate movement of the apparatus over the ground and, in the example shown, includes a plurality of ground engaging skids 5. Each skid 5 may be composed of a metal beam of appropriate section, or a plurality of such beams bolted end to end as shown in FIG. 1. It is preferred that all components of the frame structure 3 including bearers 6, uprights 7, walkways 8, steps 9, handrails 10, etc., are connected by bolts or other releasable fastening means. The aim is to provide an assembly which can be put together at the place of manufacture for testing purposes and then dismantled to be shipped in parts to the location of eventual use at which it is reassembled. Such reassembly can be aided by providing numbers or other indicia or codes on all components.

Figure 2:
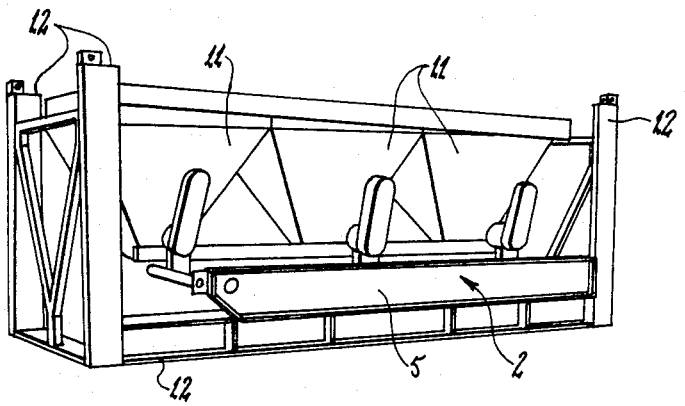
FIG. 2 is a perspective view of sections of the apparatus shown in FIG. 1 dismantled for transport purposes.

Ideally, the module 1 and any other module of which the apparatus is composed, is arranged to be broken down into sections of such a size as to allow transport in standard shipping containers. FIG. 2 shows part of the module 1 comprising hoppers or tanks 11 and a section of the base skid 5 loaded on to the frame 12 of a standard shipping container.

The example module 1 shown in FIG. 1 includes three main levels—the base level 13, a second level 14 and a third level 15. The base may support various pieces of equipment such as pumps 16, motors 17, and hoppers 11, and banks of spiral concentrators 18 are supported above the second level 14. Distributors 19 for the spiral concentrators 18 are accessible at the third level 15. There may be substantial variation in the arrangement and the nature of the equipment supported by the frame structure 3, but the particular assembly described below has been found suitable for a wide range of uses.

Figure 3:
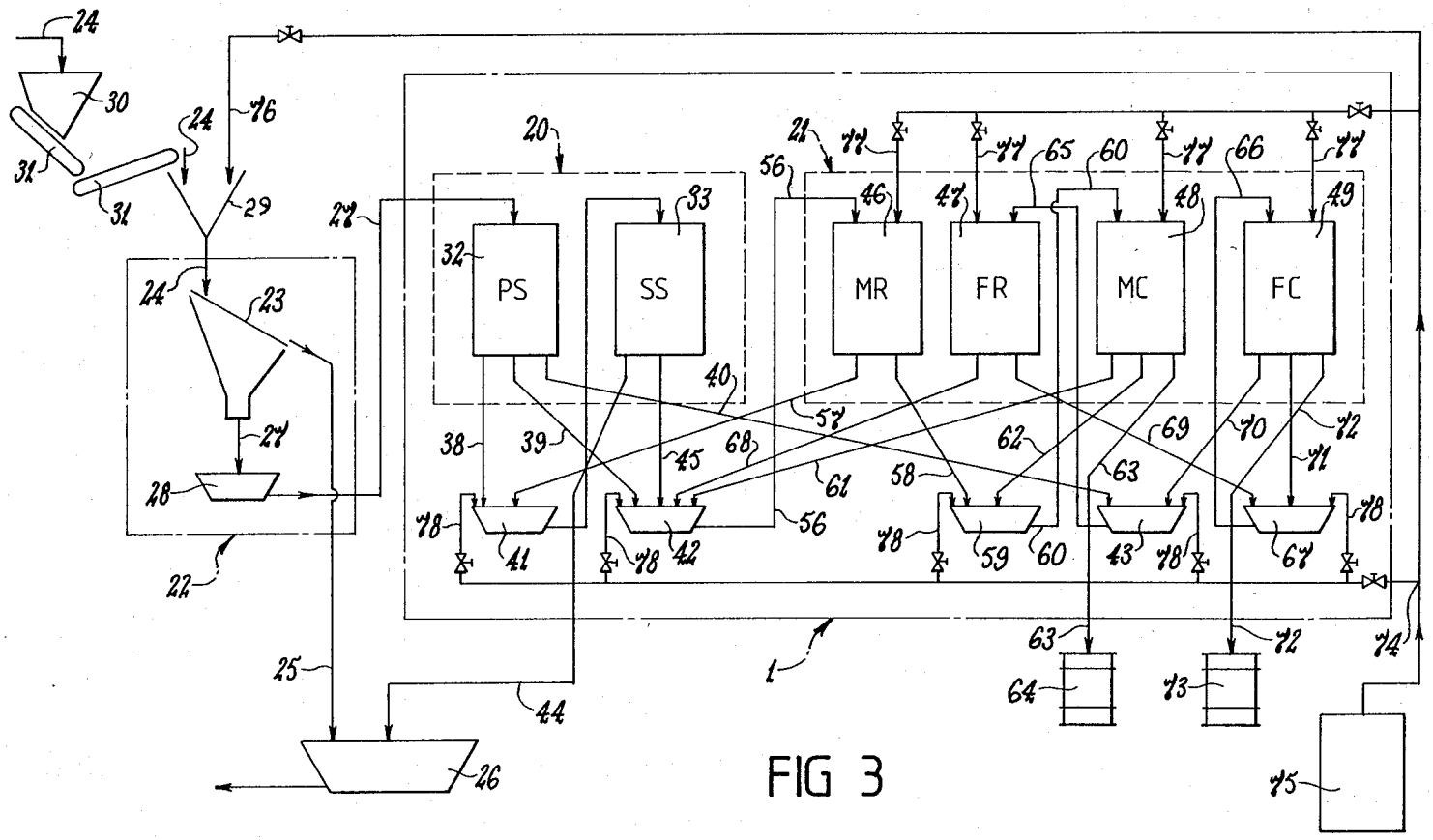
FIG. 3 is a diagrammatic view of one form of apparatus according to the invention.

In most cases, the operative equipment of the apparatus includes preliminary separation means which is in addition to the spiral concentrators 18, and the concentrators 18 are divided into primary concentrators 20 and secondary spiral concentrators 21 (FIG. 3). There is of course ancilliary equipment in the form of pumps, hoppers and valves for example, and there is also electrical and mechanical control equipment which regulates the passage of material through the various stages of the apparatus. Preferably, external sources of water and electricity are each connected to a respective single connection point provided on the apparatus from which the water and power respectively is distributed throughout the apparatus as required.

The preliminary separation means may be provided on a separate module 22 as shown diagrammatically in FIG. 3. As also shown in FIG. 3, that preliminary separation means may comprise a static screen 23 or the like which receives the feed material 24. Oversize material 25 passes across the screen 23 and is discharged to waste 26 or to a further processing station, and material 27 which falls through the screen 23 may be collected in a supply hopper 28 from which it is drawn as required. In the particular form of the apparatus shown, there is a single screen 23, but a plurality may be provided if desired. The feed arrangement whereby material 24 is fed to the screen 23 may be selected to suit requirements, but in the example shown, the feed may be from a hopper 29 which in turn receives the material 24 from a feed bin 30 by way of suitable conveyors 31.

The spiral concentrators 18 of the primary group 20 may be divided into two sub-groups—namely, initial separation 32 and scavenging 33 respectively. There may be any appropriate number of individual spirals 18 in each sub-group 32 and 33. For example, there may be eight initial separation spirals and twelve scavenging spirals, but other arrangements may be selected.

Figure 4:
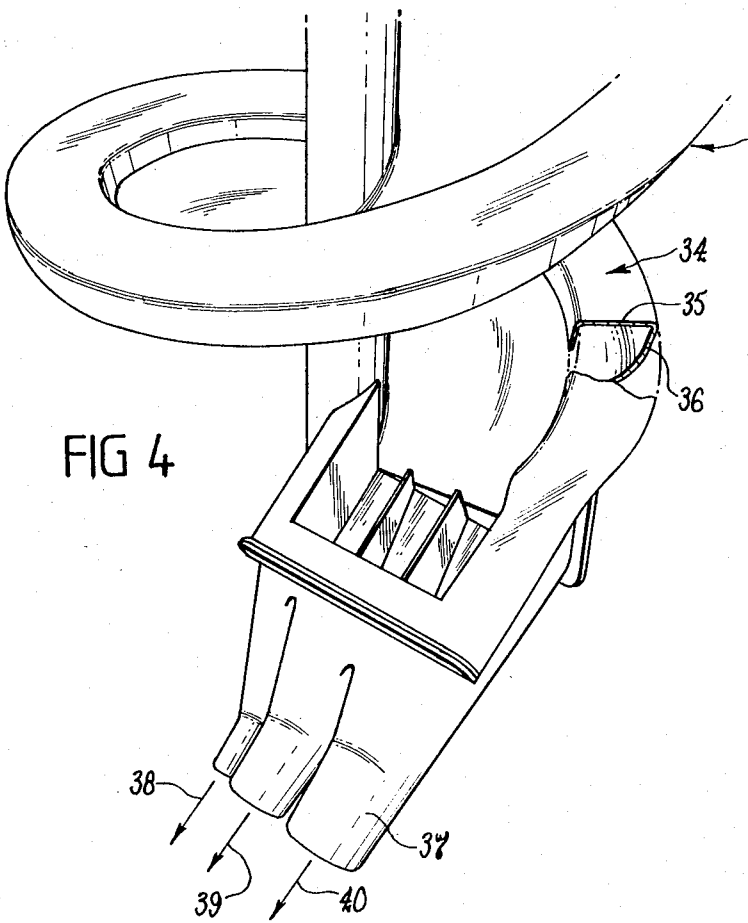
FIG. 4 is a partial view of one form of spiral concentrator for use in the apparatus of FIG. 3

Each spiral concentrator 18 of the primary group 20 is preferably formed of a glass fibre reinforced plastic or other mouldable plastics material. The cross sectional configuration of the spiral can be selected to suit requirements, but it is preferred that the spirals are of a kind which permit a high throughput. One form of such a spiral 34 is shown in FIG. 4, in which an inwardly projecting lip 35 is provided at the upper edge of the outer wall 36 so as to minimize spillage during transport of the material down the spiral 34. It is also preferred that splitting of the material into discrete streams occurs only at the bottom of each spiral 34 and appropriate splitter boxes 37 may be used for that purpose.

In the case of the spirals 34 in the initial separation sub-group 32, there may be a three way split into a tail stream 38, middlings stream 39, and concentrate stream 40 (FIG. 4), each of which leaves the spiral 34 by way of a separate path or conduit (not shown). If desired, there may be a fourth split of water. The scavenging spirals on the other hand may only split into tail and concentrate streams, with perhaps a water stream if required.

According to the example flow system of FIG. 3, material 27 is fed to each spiral 34 of the initial separation sub-group 32 from the supply hopper 28 and through distributors 19 as previously referred to. The tail, middlings and concentrate streams 38, 39 and 40 go to first, second and fourth stage holding tanks 41, 42 and 43 respectively, but again other arrangements can be adopted to suit requirements. The first stage holding tank 41 preferably provides a feed source for the spirals 34 of the scavenging sub-group 33 and the tail and concentrate streams 44 and 45 respectively from those spirals 34 may go to waste 26 (or a treatment station) and the second stage holding tank 42 respectively, as shown.

The spiral concentrators 18 of the secondary group 21 may also be formed of glass reinforced plastics or other suitable plastics material and each may have an appropriate cross sectional configuration. It is further preferred that those concentrators are divided into four sub-groups—namely, mid rougher spirals 46, fine rougher spirals 47, mid cleaner spirals 48, and fine cleaner spirals 49. By way of example only, the number of spirals 18 in each of those sub-groups may be 20, 8, 4 and 4 respectively.

Figure 5:
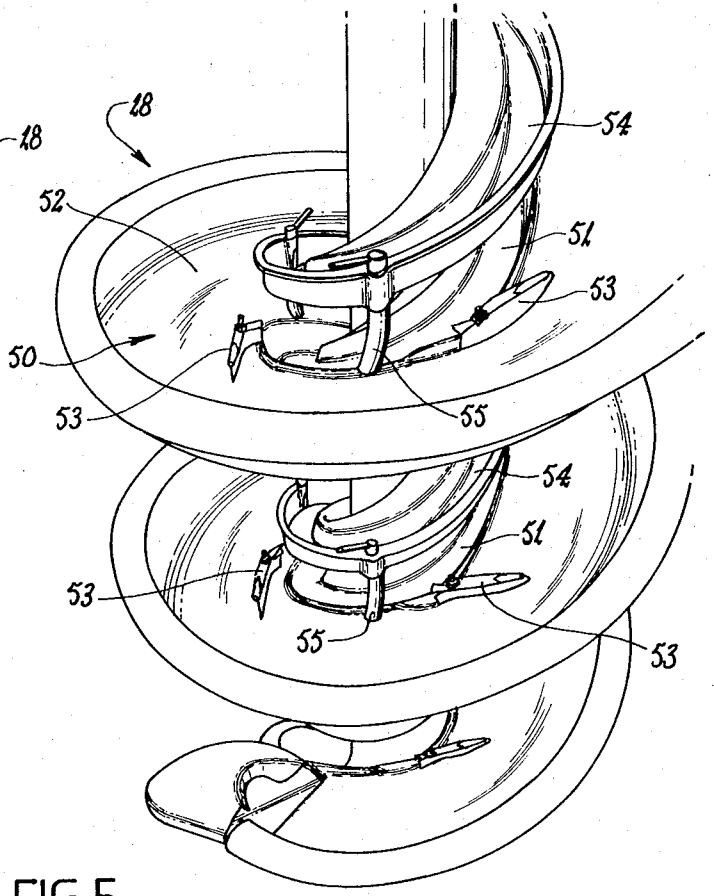
FIG. 5 is a partial view of another form of spiral concentrator for use in the apparatus of FIG. 3.

Each of the spirals 18 of the secondary group 21 may have substantially the same form. Preferably, as shown in FIG. 5, those spirals are of a form 50 having a cross section such that a concentrate channel 51 is formed along the radially inner side of the main channel 52, and a plurality of adjustable splitters 53 are provided at spaced intervals along the length of the spiral 50. Each splitter 53 may be in the form of a pivoted finger which can be adjusted as required to intrude into the material stream passing down the main channel 52 of the spiral 50 and thereby divert material from that main channel 52 into the concentrate channel 51. In that regard, each splitter 53 is preferably pivotally mounted adjacent the boundary between the main and concentrate channels 52 and 51.

It is also preferred, as shown, that a separate water sluice 54 is provided for each secondary group spiral 50. That sluice 54 may be in the form of a moulded channel located above the respective spiral 50 and having a plurality of valve controlled outlets 55 provided at spaced intervals along its length. Each outlet 55 may be arranged to discharge into the main channel 52 of the spiral 50 adjacent to the boundary with the concentrate channel 51. The valves of the outlets 55 are adjustable so that each outlet 55 can discharge a suitable quantity of water, and any or all of those outlets 55 can be completely closed if desired.

The spirals of the rougher sub-groups 46 and 47 may split the material into a concentrate stream and a tail stream, whereas the spirals of the cleaner sub-groups 48 and 49 may split the material into three streams. Once again, other arrangements can be adopted to suit particular requirements and there may be a separated water stream in any one or more of the sub-groups.

In the example flow system of FIG. 3, the spirals 50 of the mid rougher sub-group 46 receive material 56 from the second stage holding tank 42 by way of distributors 19 as previously referred to. The tail and concentrate streams 57 and 58 resulting from those spirals are discharged to the first and third stage holding tanks 41 and 59 respectively. The spirals of the mid-cleaner sub-group 48 receive material 60 from the third stage holding tank 59 and the tail and middlings streams 61 and 62 of those spirals are discharged to the second and third stage holding tanks 42 and 59 respectively. The concentrate stream 63 from the mid cleaner spirals may go to a collection zone 64 for further processing or shipment as required.

The spirals 50 of the fine rougher sub-group 47 and the fine cleaner sub-group 49 receive material 65 and 66 respectively from the fourth and fifth stage holding tanks 43 and 67 respectively. According to the arrangement shown, the tail and concentrate streams 68 and 69 of the fine rougher spirals discharge to the second and fifth stage tanks 42 and 67 respectively. The tail and middlings streams 70 and 71 of the fine cleaner spirals discharge to the fourth and fifth stage holding tanks 43 and 67 respectively, and the concentrate stream 72 of those spirals goes to a collection zone 73 for further processing or shipment as required.

FIG. 3 also shows a connection point 74 for an external water source 75. Water is distributed from the point 74 throughout the apparatus as required by means of appropriate conduit, valves and other equipment forming an integral part of the apparatus. In the example shown, the water distribution system includes a valve controlled outlet 76 at the feed to the hopper 29, valve controlled outlets 77 for the spirals of the secondary group 21 and a valve controlled outlet 78 for each of the holding tanks 41, 42, 43, 59 and 67. That is not to be considered the extent of the water distribution system, nor is it the only possible arrangement of that system.

An external source of electrical power may be also connected to and distributed throughout the apparatus in a similar manner, but that is not shown in the drawings.

The apparatus may be adapted to have various flow patterns different to that particularly described above and the nature and relative arrangement of the various components can be altered to suit individual requirements.

Figure 6:
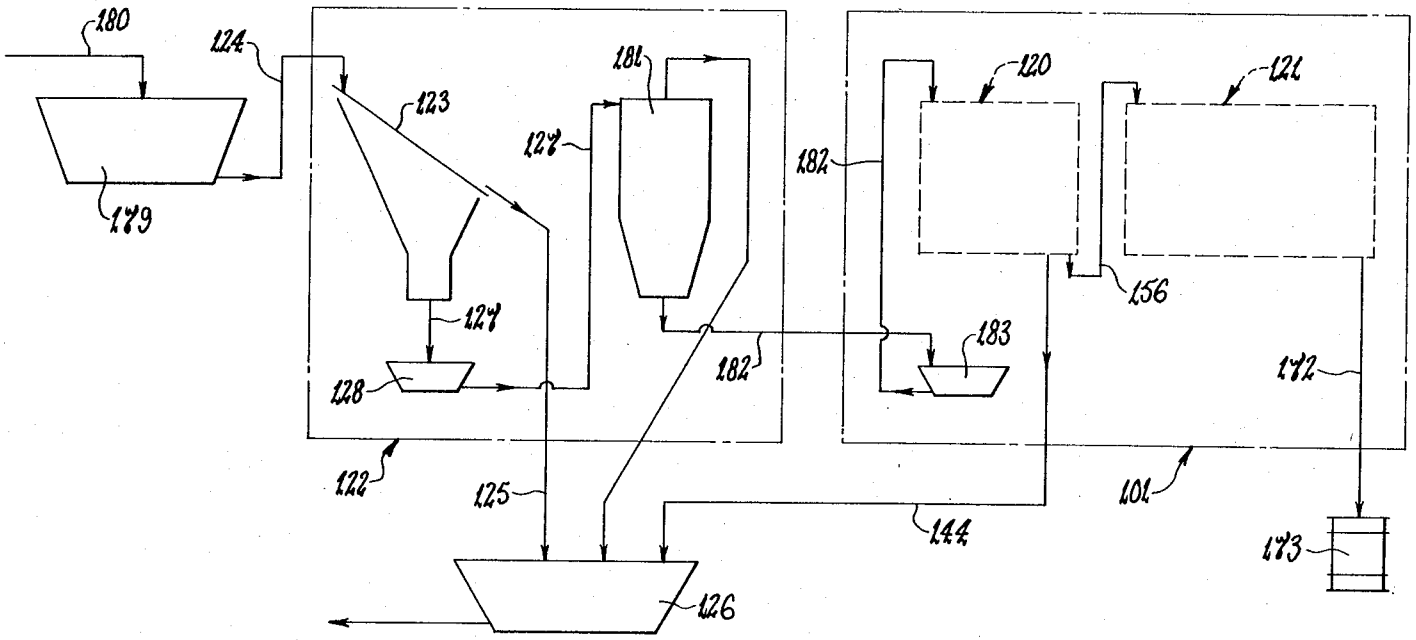
FIG. 6 is a diagrammatic view of a modified form of the apparatus shown in FIG. 3.

The apparatus so far described has been arranged for dry mining, but the apparatus is equally well suited for wet mining applications. FIG. 6 shows, in simplified form, a variation of the FIG. 3 system which is adapted for wet mining applications. Parts of the FIG. 6 system which have corresponding parts in FIG. 3 will be given like reference numerals except that they will be in the number series 100–199.

The apparatus of FIG. 6 includes two modules 101 and 122 as in the FIG. 3 arrangement, but in this case the preliminary separation module 122 receives feed material 124 from a dewatering or constant density tank 179. The tank 179 receives a slurry 180 which is a product of the mining process, and the material 124 fed from the tank 179 has a lower water content than the slurry 180. The module 122 as shown includes an inclined screen 123 which separates the material 24 into waste and treatment components 125 and 127 respectively. The treatment component 127 is preferably fed to at least one hydrocyclone 181 for slime removal purposes and the output 182 of that hydrocylone 181 is fed to a sump or tank 183 from which it is drawn for processing through the concentrator module 101 in the manner previously described.

Figure 7:
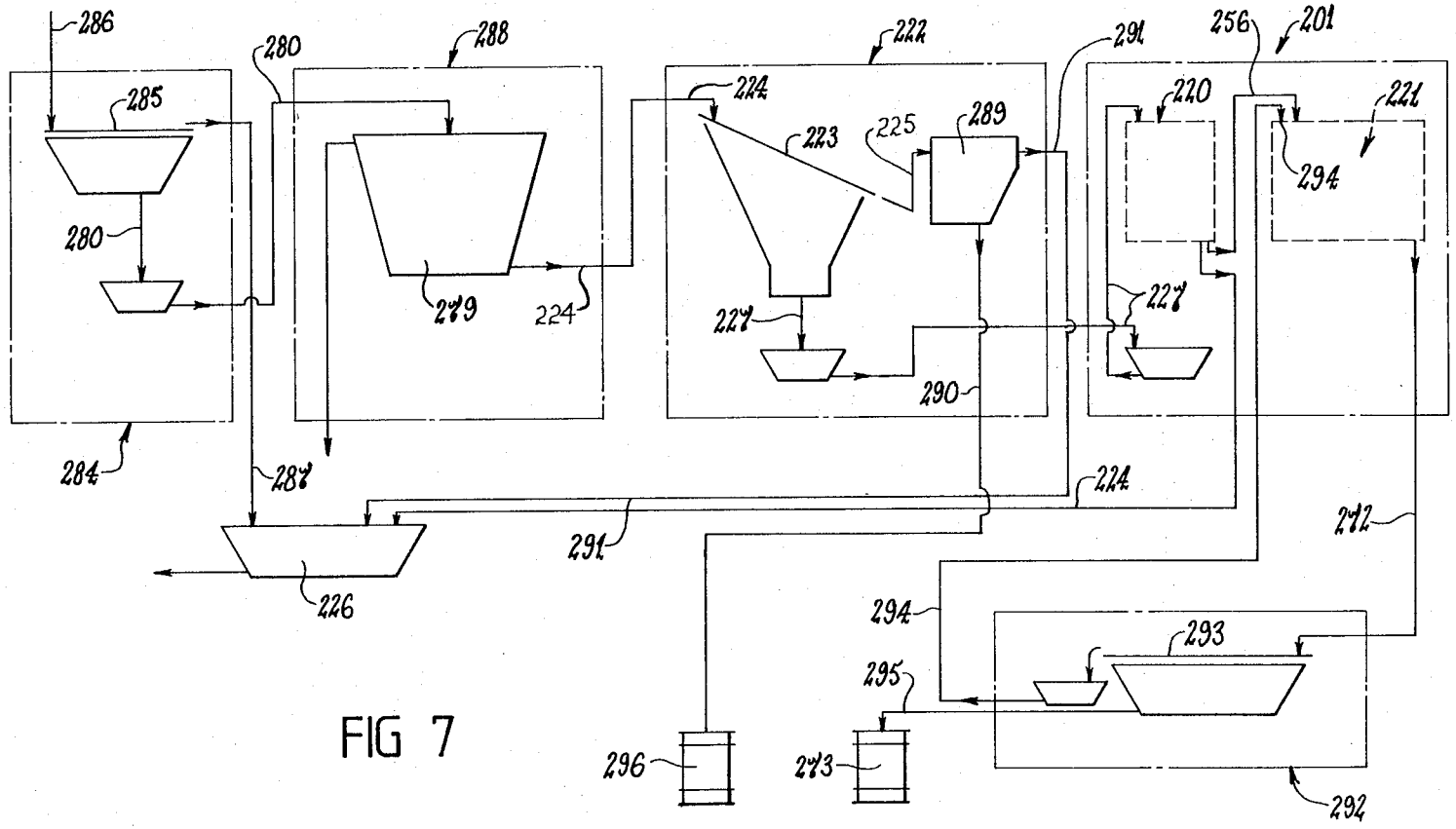
FIG. 7 is a diagrammatic view of a modified form of the apparatus shown in FIG. 6.

FIG. 7 shows a more sophisticated version of the FIG. 6 system in which there are five separate modules—namely, a primary screen module, a dewatering module, a preliminary separation module, a concentrator module and a final dressing module. Parts of the FIG. 7 system which have corresponding parts in FIGS. 3 and 6 will be given like reference numerals except that they are put in the number series 200–299.

The primary screen module 284 includes a vibrating screen 285 which receives the as-mined material 286 and separates it into waste and treatment components 287 and 280. The treatment component 280 is a slurry as previously referred to and is transported to the dewatering module 288 for treatment by the dewatering tank 279 to produce a relatively dry output 224 as previously referred to. The preliminary separation module 222 includes an inclined screen 223 which functions as previously described, and the oversize material 225 passing over that screen 223 is fed to jig separators 289, whereas the undersize material 227 which passes through the screen 223 is fed to the concentrator module 201 for further processing. The jig separators 289 function in a known manner to produce a concentrate stream 290 and a waste stream 291. The particle size of the concentrate stream 290 is too course for further processing in the concentrator module 201 and is passed to a collection zone 296.

The fine dressing module 292 includes a shaking table 293 which separates the output 272 of the secondary concentrators 221 into tail and concentrate streams 294 and 295 respectively. The tail stream 294 may be returned to the secondary concentrators 221 for further processing and the concentrate stream 295 is directed to a collection zone 273 for further processing or shipment as required.

Figure 8:
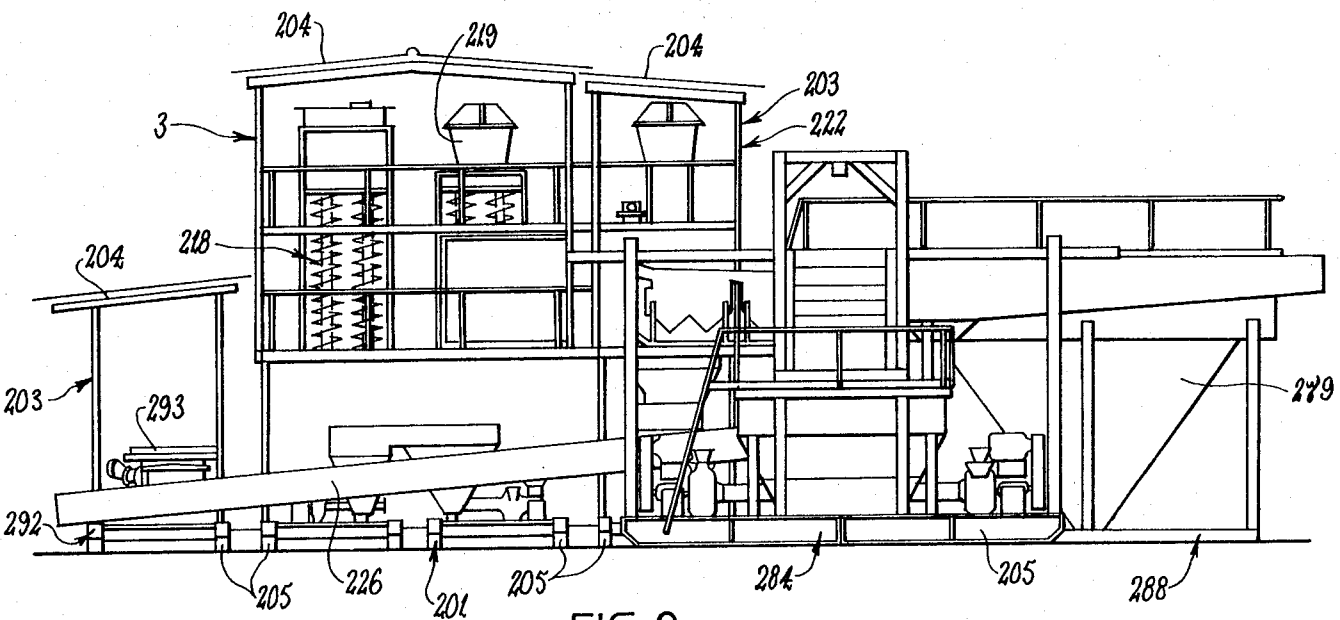
FIG. 8 is a side elevational view of apparatus in accordance with FIG. 7.
Figure 9:
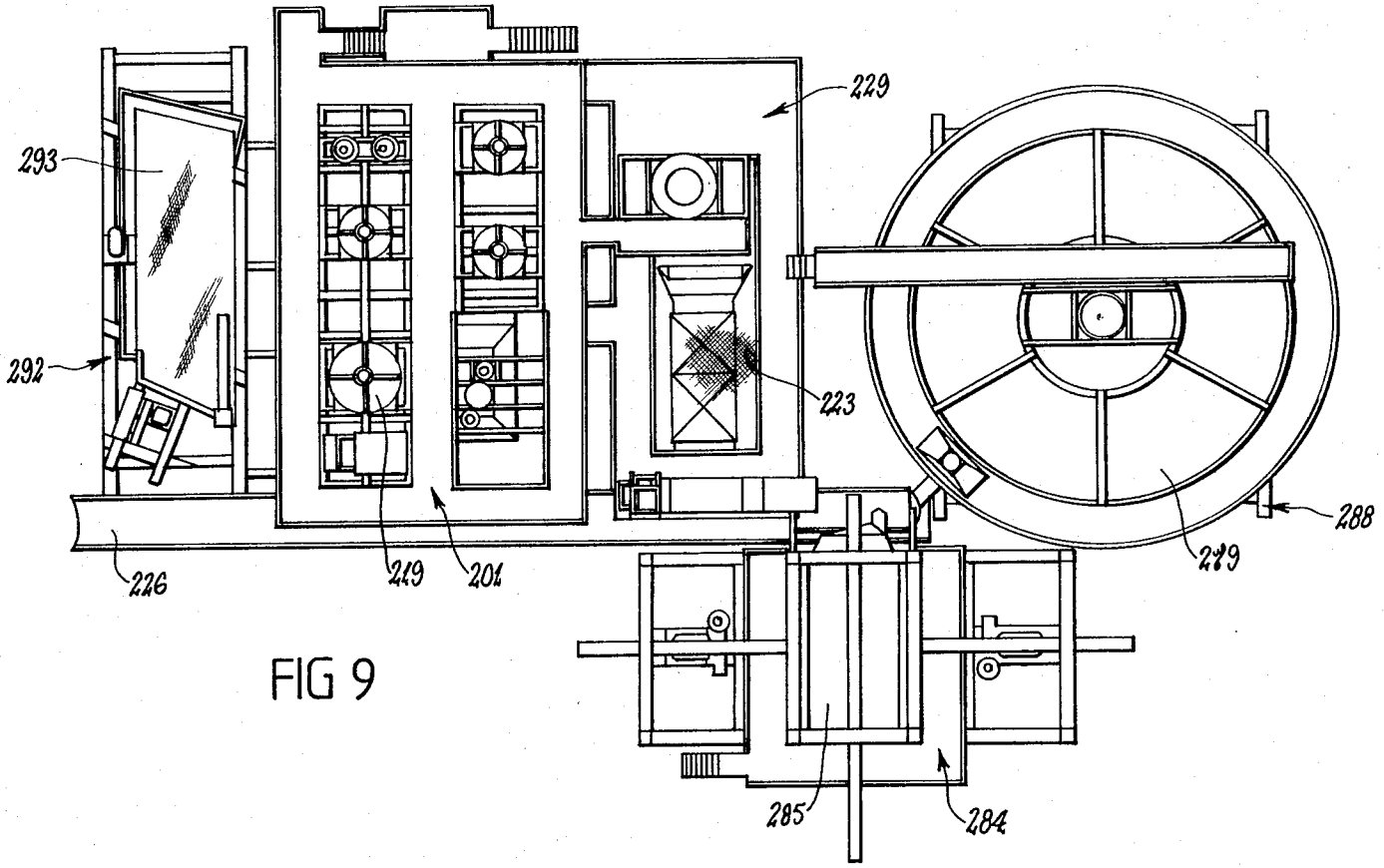
FIG. 9 is a plan view of the apparatus shown in FIG. 8.

FIGS. 8 and 9 show the FIG. 7 arrangement in greater detail, and it is to be noted that the roof structures have been omitted from FIG. 9 for convenience of illustration. The apparatus shown in FIGS. 8 and 9 is fully operational subject only to connection of a water supply and power source. That is, the apparatus is fully integrated in that all necessary ancilliary equipment such as motors, pumps, control equipment and distribution means (e.g., conduits) are connected to and moved with respective modules. Such ancilliary equipment operates in a manner well understood by those skilled in the relevant art and consequently will not be further described.

The arrangements described are open to substantial variation without departing from the concept of the invention. For example, preliminary separation of the feed material may be carried out in a scrubber/trommel screen located separate from the apparatus or included as an integral part of the apparatus. Such a scrubber/-trommel screen arrangement may be additional to the static inclined screen described for preliminary separation purposes. Furthermore, the particular spiral concentrators described in relation to FIGS. 4 and 5 are examples only and spirals of forms different to those described may be used.

Apparatus as described is substantially self contained in that it can exist if isolation from other processing plant or equipment. It may be used in isolated locations and for that purpose can be powered by a portable generator. The portability of the apparatus allows it to be conveniently shifted to maintain proximity with the material supply source. Furthermore, the knock-down character of the apparatus allows for convenient shipment from the manufacturing site to the user site, or from one user site to another.

It has been found that apparatus as described can be successfully used for recovery and beneficiation of mineral particles in small size ranges in a manner not previously possible. For example, it is capable of recovering cassiterite particles in the range of two millimetres to forty microns. The apparatus is suitable for gravity concentration of tin, scheelite, wolfram, gold and other heavy minerals to produce either a finished concentrate or preconcentrate for reduced transport to a main dressing plant.

Various alterations, modifications and/or additions may be introduced into the constructions and arrangements of parts previously described without departing from the spirit or ambit of the invention as defined by the appended claims.

Having now described our invention what we claim as new and desire to secure by Letters Patent is:

1. Mobile mineral processing apparatus comprising; a plurality of groups of gravity concentrators, at least one of which includes spiral concentrators; a plurality of treatment means including primary separation means, scavenging means, and cleaning means; each of at least two of said treatment means including a said group of gravity concentrators; at least one module carrying said treatment means, water reticulation means and control means for regulating the flow of material through said apparatus; said module having a base, a frame structure and a roof, and said base is engagable with the ground for movement thereover.

2. Apparatus according to claim 1, wherein there is a plurality of said modules, one said module forms a concentrate module and carries said treatment means, at least part of said reticulation means and at least part of said control means.

3. Apparatus according to claim 2, wherein said treatment means includes final dressing means.

4. Apparatus according to claim 2, wherein a further said module carries preliminary separation means which includes at least one inclined screen for receiving feed material and separating that material into treatment and waste components.

5. Apparatus according to claim 4, wherein said further module carries at least one jig separator which is operative to receive said treatment material from said inclined screen and separate it into further treatment and waste components.

6. Apparatus according to claim 2, wherein each of said primary separation means, scavenging means and cleaning means includes at least one said spiral concentrator.

7. Apparatus according to claim 6, wherein each said spiral concentrator of both said primary separation means and said scavenging means has an inwardly directed lip provided around the upper edge of the spiral outer wall, and stream splitting means is provided in the lower region of the spiral.

8. Apparatus according to claim 6, wherein each said spiral concentrator of said cleaning means has a concentrate channel formed along the radial inner side thereof, stream splitters are provided in the spaced relationship along the length of each said spiral, and each said splitter is operable to divert material from a main channel of the spiral to said concentrate channel thereof.

9. Apparatus according to claim 8, wherein a separate water sluice is provided for each said cleaning means spiral, said sluice is located above the respective said main channel and has a plurality of valve controlled outlets through which water can be discharged into said main channel.

10. Apparatus according to claim 4, wherein said preliminary separation means includes slime removal means for receiving said treatment component from the inclined screen and dividing that component into further treatment and waste components, and pump means is provided for directing said further treatment component to said primary separation means.

11. Apparatus according to claim 2, wherein a further one of said modules carries final dressing means.

12. Apparatus according to claim 11, wherein said final dressing means includes a shaking table.

13. Mobile mineral processing apparatus comprising; a plurality of modules, each of which includes a base, a frame structure and a roof, each said base having ground engaging means such that the respective module can be moved over the ground from place to place; each said module being of demountable construction such as to permit partial separation for convenient transport from one location and reassembly at another location; said modules include a preliminary separation module and a concentrate module, each of which carries a respective part of water reticulation means and control means for regulating the flow of material through said apparatus; said preliminary separation module includes separation means for dividing feed material into treatment and waste components, and transfer means for transporting said treatment component to said concentrate module; and said concentrate module includes a plurality of groups of gravity concentrators forming primary separation means, scavenging means and cleaning means, at least some of said gravity concentrators being spiral concentrators, and said gravity concentrators are arranged to receive and process said treatment component.

14. Apparatus according to claim 13, wherein said modules include a final dressing module which carries a shaking table for receiving and processing material received from said concentrate module and which constitutes the residue of said treatment component not rejected to waste in the course of being processed through said concentrate module.

15. Apparatus according to claim 13, wherein there are two groups of said spiral concentrators forming primary and secondary concentrators respectively, said primary concentrators comprise said primary separation means and said scavenging means, and said secondary concentrators comprise said cleaning means.

16. Apparatus according to claim 15, wherein said concentrate module includes a plurality of holding tanks for material being processed through said gravity concentrators.

17. Apparatus according to claim 16, wherein said holding tanks include at least first and second stage tanks, and there is provided means for feeding material to be processed to said primary separation means which is operative to separate the received material into at least a tail stream and a concentrate stream, and transport means for directing said tail stream into said first stage holding tank and said concentrate stream into at least one other said holding tank, said first stage holding tank provides a feed source for said scavenging means which is operative to separate the received material into at least a tail stream and a concentrate stream, further transport means is provided for directing said concentrate stream from the scavenging means to said second stage tank, and said second stage tank forms at least part of a feed source for said secondary concentrators.

18. Apparatus according to claim 16, wherein said secondary concentrators are divided into a plurality of sub-groups which are operative to direct streams of material processed thereby into selected said holding tanks according to the classification of each said stream, and transport means is provided for redirecting material received by one said holding tank from one said sub-group to another said sub-group for reprocessing to produce a stream having a higher classification than said redirected material.

19. Apparatus according to claim 18, wherein further transport means is provided for redirecting material of low clasification from at least one of said sub-groups to said primary concentrators for further processing by at least said scavenging means.

20. Apparatus according to claim 15, wherein said primary and secondary concentrators are arranged to divide material received thereby into a plurality of streams, stream dividing means is provided in the lower part only of said primary concentrators, and stream dividing means is provided along the length of said secondary concentrators.

21. Apparatus according to claim 13, wherein feed material preparation is provided and includes a vibrating screen adapted to receive the feed material and separate it into waste and treatment components, and a dewatering tank arranged to receive said treatment component from said vibrating screen, and means is provided to transport dewatered material from said dewatering tank to said preliminary separation tank to said preliminary separation module.

22. Apparatus according to claim 21, wherein said vibrating screen and said dewatering tank are carried by respective said modules.

* * * * *